US006606933B2

(12) United States Patent
Falk

(10) Patent No.: US 6,606,933 B2
(45) Date of Patent: Aug. 19, 2003

(54) TURRET FOR A COMBAT UNIT

(75) Inventor: Alfons Falk, Bonassund (SE)

(73) Assignee: Alvis Hagglunds Aktiebolag, Ornskoldsvik (SE)

( * ) Notice: Subject to any disclaimer, the term of this patent is extended or adjusted under 35 U.S.C. 154(b) by 0 days.

(21) Appl. No.: 10/111,317

(22) PCT Filed: Aug. 21, 2001

(86) PCT No.: PCT/SE01/01781

§ 371 (c)(1),
(2), (4) Date: Apr. 24, 2002

(87) PCT Pub. No.: WO02/16857

PCT Pub. Date: Feb. 28, 2002

(65) Prior Publication Data

US 2002/0170420 A1 Nov. 21, 2002

(51) Int. Cl.[7] ..... F41A 9/34
(52) U.S. Cl. ..... 89/46; 89/45; 89/33.14
(58) Field of Search ..... 89/36.08, 45, 46, 89/33.14

(56) References Cited

U.S. PATENT DOCUMENTS 2,649,840 A * 8/1953 Davidson, Jr.
3,045,553 A * 7/1962 Mosle
4,706,544 A * 11/1987 Zielinski et al. ..... 89/46
4,966,064 A * 10/1990 Kaustrater et al. ..... 89/46
4,976,185 A 12/1990 Wixon et al. ..... 89/35.01
5,076,138 A 12/1991 Mannhart et al. ..... 89/34

FOREIGN PATENT DOCUMENTS

DE 36 27 261 A1 * 2/1988 ..... 89/46
DE 41 26 688 C1 9/1996
EP 346 790 * 12/1989

* cited by examiner

*Primary Examiner*—Stephen M. Johnson
(74) *Attorney, Agent, or Firm*—Young & Thompson

(57) ABSTRACT

Turret (12) fitted with automatic canon and intended for a combat unit, said turret (12) comprising a turret housing (14) which is intended to be mounted on the outside of the combat unit and can rotate about a substantially vertical axis, and in which turret housing (14) there is a weapon holder (16) for pivotably supporting a canon about a horizontal axis, which canon has a barrel (20) projecting from the turret housing (14) and a rear part (22) with associated loading mechanism (24) situated inside the housing (14). At least one ammunition magazine (26, 28) is arranged to the side of the rear part (22) of the canon and has an outlet (29, 31) for the ammunition belt situated in such a way that the latter can be conveyed from a rear part of the magazine and guided forwards along an underside (33) of the magazine and thereafter curved through ca. 90° about an axis substantially at right angles to the plane of the belt for feeding the projectiles to the loading mechanism (24).

4 Claims, 3 Drawing Sheets

TURRET FOR A COMBAT UNIT

TECHNICAL FIELD

The present invention relates to an unmanned and compact turret for a combat unit, in particular for a combat vehicle, said turret being fitted with automatic canon and comprising a turret housing which is intended to be mounted on an outside of the combat unit and can rotate about a substantially vertical axis, and in which turret housing there is a weapon holder for pivotably supporting a canon about a horizontal axis, which canon has a barrel projecting from the turret housing and a rear part with an associated loading mechanism situated inside the housing, at least one ammunition magazine being arranged in the turret for accommodating a projectile-supporting chain belt which can on the one hand fold between individual chains of the belt about an axis substantially parallel to the projectiles and on the other hand can curve in its own plane about an axis situated outside the belt and substantially at right angles to the plane of the belt.

BACKGROUND TO THE INVENTION

In modern combat vehicles, there is an ever increasing requirement for small, compact and unmanned turrets equipped with automatic canon which can be remote-controlled from an operator position, for example in a crew module underneath in the vehicle. For this purpose, the turret must be able to accommodate the necessary electrical and mechanical guidance equipment for the automatic canon, optical instruments, such as IR cameras, lasers, CCD cameras, sensors, etc., and at least one ammunition magazine from which projectiles are to be fed via chain belts to a loading mechanism located in the rear part of the canon. An additional requirement is that external parts of the turret should be designed to give the lowest possible radar and IR signature. A factor which greatly influences the dimensioning of the turret is the position of the ammunition magazine or magazines and the arrangement of the conveyor for the ammunition belts running out from said magazine or magazines.

U.S. Pat. No. 4,976,185 discloses an arrangement for feeding ammunition into an automatic weapon in a helicopter gun turret. The ammunition magazine is positioned a substantial distance behind the weapon, and the ammunition is fed in a wide and space-consuming loop around the weapon.

U.S. Pat. No. 5,076,138 discloses a manned turret with the ammunition magazines positioned far below the weapon, with a conveyor system which allows ammunition to be fed to an elevatable weapon. The conveyor loops (chain belts) of the feed system here require a relatively large space both vertically and horizontally, for which reason the turret, in addition to the area for the crew, is correspondingly larger and thus not optimally compact.

DE-C1-4 126 688 discloses a heavy combat vehicle with an unmanned turret fitted with canon, the ammunition being fed from a position in the vehicle body underneath.

Solution Provided by the Invention

It is therefore an object of the invention to propose a new and improved arrangement of ammunition magazines in turrets in order to achieve optimally small dimensions of same. For this purpose, the turret according to the invention specified in the introduction is characterized in that the magazine is arranged to the side of the rear part of the canon and has an outlet for the ammunition belt situated in such a way that the latter can be conveyed from a rear part of the magazine and guided forwards along an underside of the magazine and thereafter curved through about 90° about an axis substantially at right angles to the plane of the belt for feeding the projectiles to the loading mechanism. Since the ammunition belt is normally stored in folded loops in a magazine casing to the side of the canon and the projectiles are directed substantially at right angles to their future position in the canon and with their points directed away from the latter, the width and length dimensions of the turret can be kept to a minimum. The belt can in this case be reeled off from above and led out via an outlet opening at the rear of the magazine and thereafter conveyed along the underside of the magazine, for which reason the structural height of the turret can also be kept relatively low. Before the projectiles are fed into the loading mechanism of the canon with their point directed forwards, the ammunition belt therefore has to be curved through about 90° about an axis oriented substantially at right angles to the plane of the belt, which can be done with a radius of curvature of about 50 cm for an ammunition length of about 22 cm and caliber of 25 mm.

It is particularly expedient to arrange two ammunition magazines placed one on top of the other, these magazines being able to contain, in a known manner, different types of ammunition, for example armour-piercing projectiles or high-explosive shells. The outlets for the respective ammunition belts are in this case arranged on a rear wall of the magazines.

Further features of the turret according to the invention will be explained in detail below with reference to the attached drawings.

PREFERRED EMBODIMENT OF THE INVENTION

Figure 1:
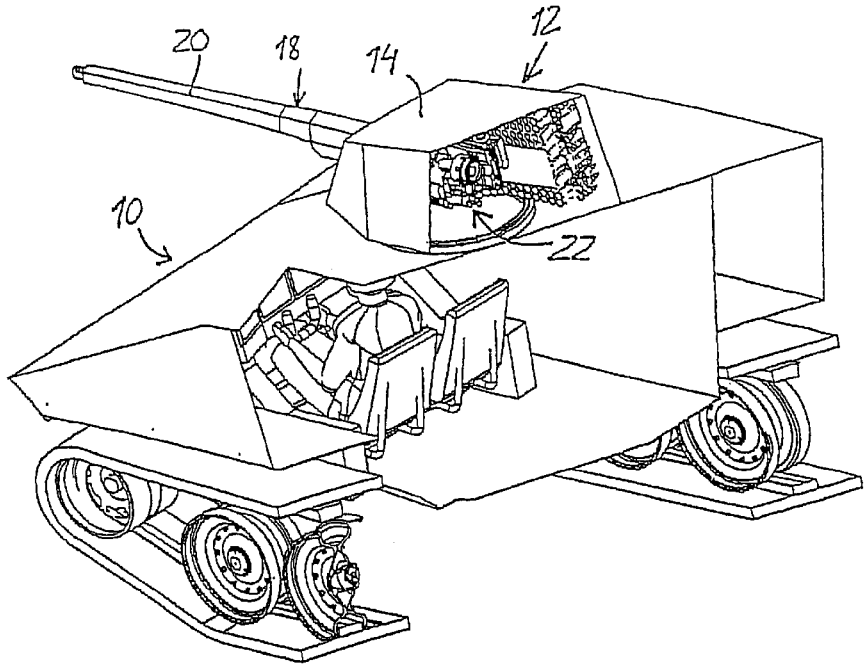
FIG. 1 is a partially cutaway perspective view of a front area of a combat vehicle fitted with automatic canon and with a remote-controlled, compact turret according to the present invention.
Figure 3:
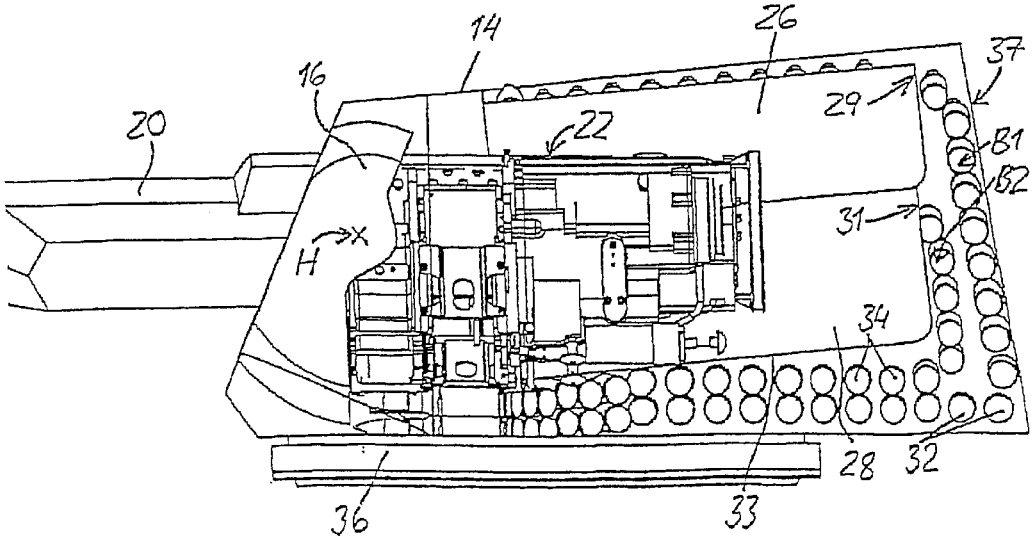
FIG. 3 is a side view of the turret in FIG. 2.

In FIG. 1, reference number 10 generally designates a combat unit, here in the form of a caterpillar-tracked combat vehicle equipped with a compact turret 12 of small dimensions fitted with automatic canon, which turret 12 is mounted on a top face of the vehicle in such a way that it can rotate about a vertical axis. The turret 12 comprises a housing 14 in which there is a weapon holder 16 which supports an automatic canon 18 pivotably about a horizontal axis H (FIG. 3) for elevating the canon. The canon 18 has a barrel 20 projecting from the front face of the housing, and a rear part 22 with an associated loading mechanism 24 on its underside.

Two ammunition magazines 26 and 28, each of which accommodates a loop 30 of ammunition projectiles 32 and 34, respectively, which are carried on chain belts and are preferably of two different types, for example armour-piercing projectiles and high-explosive shells, are placed one on top of the other to one side of the rear part 22 of the canon.

Figure 2:
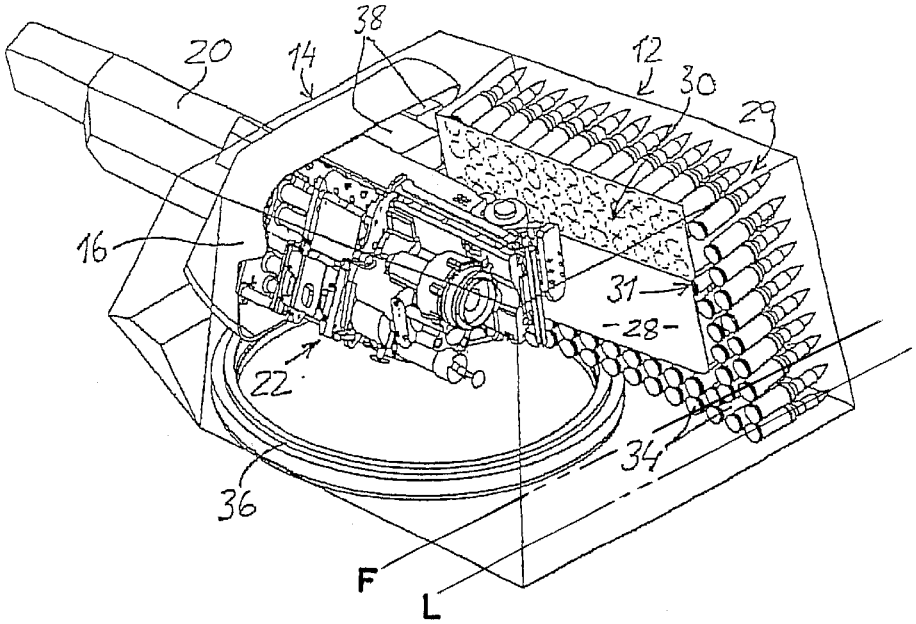
FIG. 2 is a cutaway perspective view, from behind, of a turret according to the invention.
Figure 4:
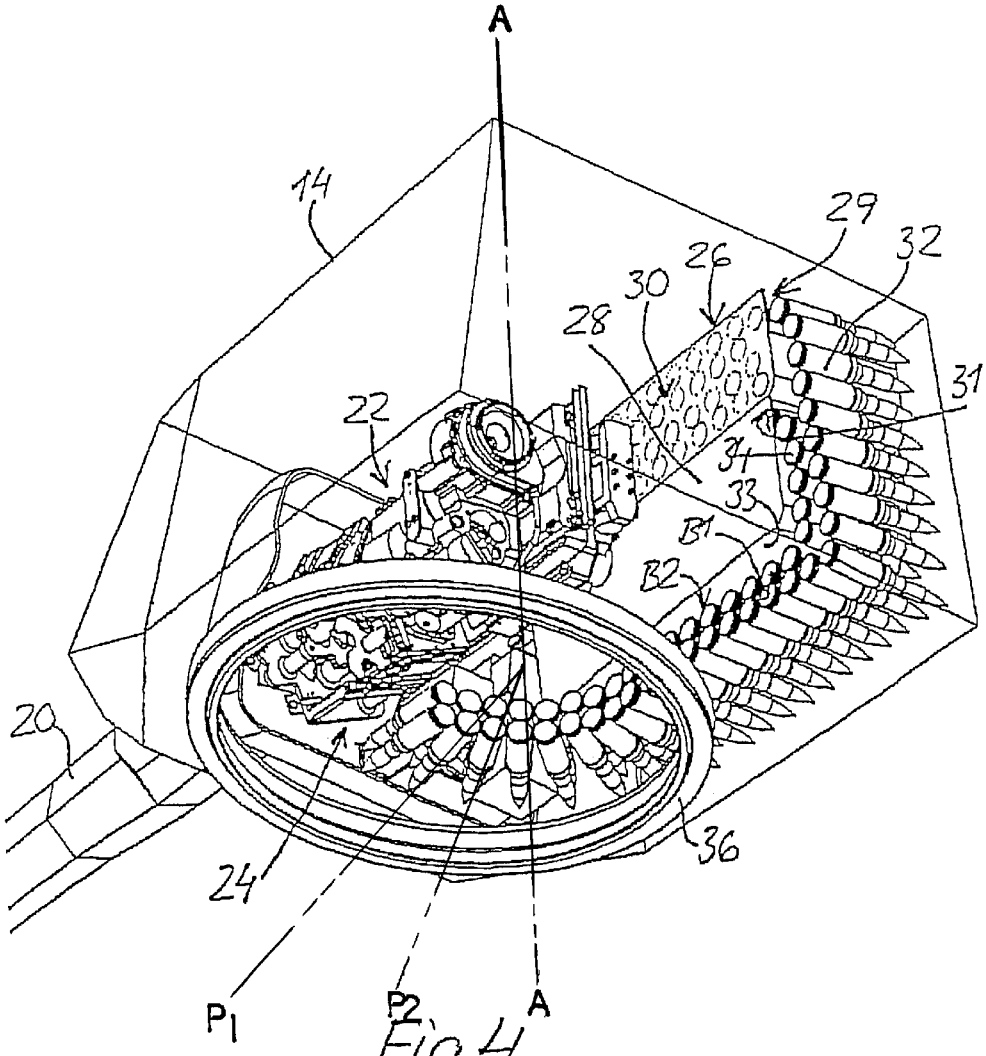
FIG. 4 is a cutaway perspective view, from underneath, of the turret according to the invention.

The chain belts B1 and B2 are of a type known per se and consist of individual chains (not shown) with elements gripping the car ridge cases, the chains of the belts being connected in an articulated manner about an axis F (FIG. 2) parallel to a longitudinal axis L (FIG. 2) of the projectiles 32, 34 and articulate in the plane of the belt P1–P2 (FIG. 4) about an axis A—A (FIG. 4) located outside the belt and substantially at right angles to its plane, so that the belt can be curved in order to change the positioning of the projectiles from a position in which they lie substantially at right angles to the longitudinal axis of the canon 18, with their points directed away from the latter, to a position in which they are oriented parallel to the cannon axis with their points directed forwards, as is shown in FIG. 4. The respective ammunition belts B1 and B2 run out of the magazines 26, 28 from a rear and upper area of these (at 29 and 31 respectively), where they are deflected downwards and then conveyed forwards along the underside 33 of the lower magazine 28 to a front area of the latter, where the belt is then curved in its own plane through about 90° in towards the loading mechanism 24 in the lower part of the rear part 22 of the canon.

The actual guidance and curving of the ammunition belts B1 and B2 from the magazines 26, 28 to the loading mechanism 24 can be obtained using deflector wheels, hinge plates, flexible guide channels and the like (not shown), and the arrangement of these is preferably such that access is permitted to the ammunition from inside the operator position via the opening in the turret base 36 in the event of problems with the delivery.

The ammunition magazines 26, 28 can preferably be inserted into and removed from the turret 14 via an openable hatch 37 (FIG. 3) in a rear wall of the housing for loading and reloading the magazines.

Figure 5:
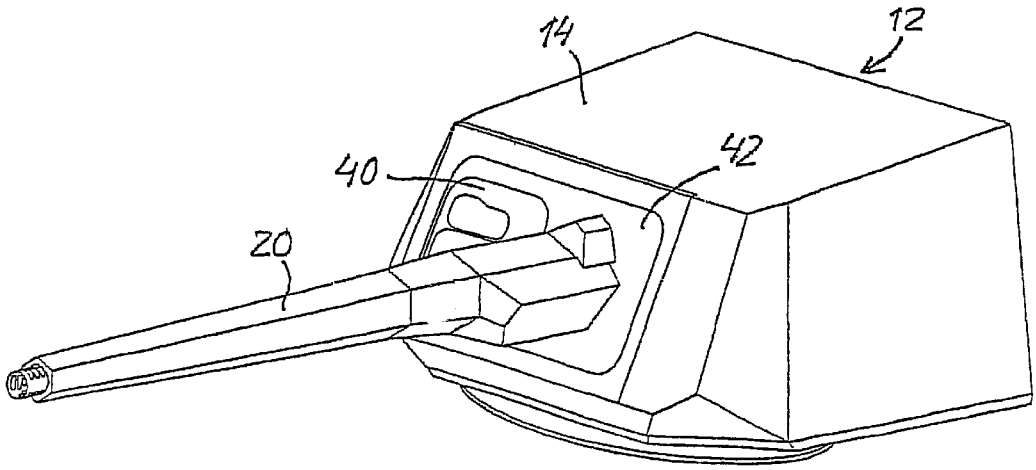
FIG. 5 is a perspective view, from in front, of a turret according to the invention.

The turret 12 is also made extremely compact by the fact that the optical instrumentation necessary for manoeuvring the vehicle and the automatic canon, including IR cameras, distance lasers, CCD cameras, various sensors, etc., are placed as module units 38 (FIG. 2) immediately in front of the ammunition magazines 26, 28 to the side of the rear part of the canon, said modules being mounted on the weapon holder 16. As will be clear from FIG. 5, this optical instrumentation has a front face 40 lying flush with a preferably plane front face 42 of the weapon holder 16 of the canon, by which means it is possible to obtain a favourable IR and RR signature of the turret 12, particularly at normal elevation of the canon.

What is claimed is:

1. Unmanned and compact turret fitted with automatic canon and intended for a combat unit, said turret comprising:

a turret housing which is intended to be mounted on an outside of the combat unit and can rotate about a substantially vertical axis; and a weapon holder in said turret housing for pivotably supporting a canon about a horizontal axis, said canon has a barrel projecting from the turret housing, and a rear part with an associated loading mechanism situated inside the housing, at least one ammunition magazine being arranged in the turret for accommodating a projectile-supporting chain belt which can fold between individual chains of the chain belt about an axis substantially parallel to a longitudinal axis of the projectiles and can curve in a plane about an axis substantially at right angles to said plane, said plane being defined by longitudinal axes of a pair of immediately adjacent projectiles, wherein said magazine is arranged to a side of the rear part of the canon and has an outlet for the chain belt situated in such a way that the chain belt can be conveyed from a rear part of the magazine and guided forwards along an underside of the magazine and thereafter curved through about 90° about the axis substantially at right angles to the plane defined by the longitudinal axes of the pair of immediately adjacent projectiles for feeding the projectiles to the loading mechanism.

2. The turret according to claim 1, wherein the turret housing accommodates two ammunition magazines placed one on top of the other, outlets for respective chain belts being arranged on a rear wall of each magazine.

3. The turret according to claim 2, wherein the chain belts are guided alongside each other and substantially parallel to each other.

4. The turret according to claim 1, wherein each magazine can be inserted into and removed from the turret housing via an openable hatch in the turret.

* * * * *

UNITED STATES PATENT AND TRADEMARK OFFICE

CERTIFICATE OF CORRECTION

PATENT NO. : 6,606,933 B2
DATED : August 19, 2003
INVENTOR(S) : Alfons Falk

It is certified that error appears in the above-identified patent and that said Letters Patent is hereby corrected as shown below:

Title page,
Insert item [30] as follows:
-- [30] Foreign Application Priority Data
Aug. 25, 2000 (SE) ..... 0003019-7 --.

Signed and Sealed this

Twenty-seventh Day of April, 2004

JON W. DUDAS
*Acting Director of the United States Patent and Trademark Office*